US005556330A

United States Patent [19]

Schweikert

[11] Patent Number: 5,556,330

[45] Date of Patent: Sep. 17, 1996

[54] FLOOR OUTLET

[75] Inventor: Wolfgang Schweikert, Stolberg, Germany

[73] Assignee: H. Krantz-TKT GmbH, Bergisch Gladbach, Germany

[21] Appl. No.: 386,006

[22] Filed: Feb. 9, 1995

[30] Foreign Application Priority Data

Feb. 23, 1994 [DE] Germany ..... 44 05 867.5

[51] Int. Cl.[6] ..... F24F 13/06

[52] U.S. Cl. ..... 454/289; 454/308

[58] Field of Search ..... 454/284, 289, 454/290, 298, 299, 300, 311, 323, 308

[56] References Cited

U.S. PATENT DOCUMENTS 5,058,490 10/1991 Sodec et al. ..... 454/290

*Primary Examiner*—Harold Joyce

*Attorney, Agent, or Firm*—Paul J. Sutton; Mark T. Basseches

[57] ABSTRACT

A floor mountable air outlet adapted to distribute a generally vertical or a generally horizontal air stream is disclosed. The outlet includes an uppermost plate having an inner and an outer series of openings inclined relative to the plane of the plate. The plate forms the upper surface of a cylinder and there is mounted within the cylinder a disk shiftable toward and away from the plate. In the uppermost position of the disk the inner series of openings is blocked resulting in a generally vertical air flow, whereas in the lowered position of the disk a generally horizontal flow is obtained.

5 Claims, 2 Drawing Sheets

FIG. 1
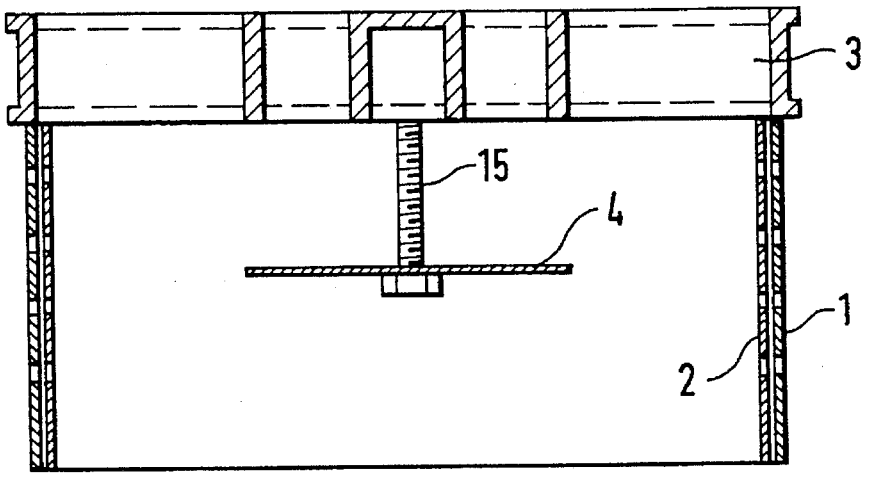
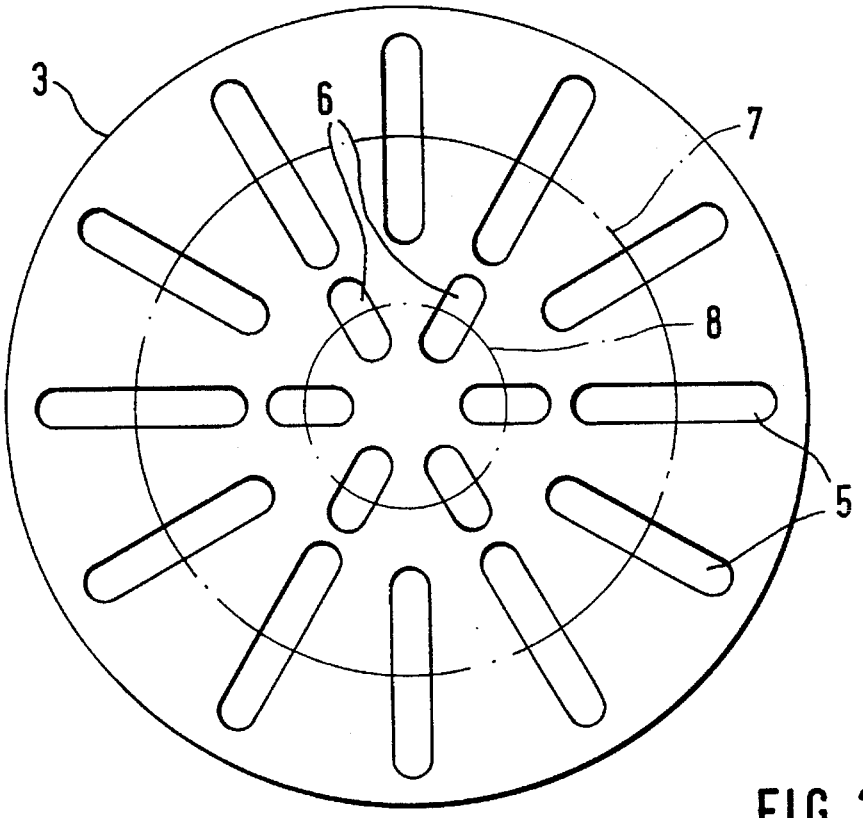
FIG. 2

FLOOR OUTLET

BACKGROUND OF THE INVENTION

This invention concerns a floor outlet for controlling air flow and essentially consisting of a cylindrical casing which can be placed into an opening in the floor, and of a circular plate which fully covers the casing and has been provided with outlet openings. Under the plate there is located a vertically adjustable disk by means of which, depending on its position, cross sections of the outlet openings can be completely closed or opened.

PRIOR ART

In the case of such a floor outlet known from DE 39 28 621 A1 the cylindrical casing is provided with collar which radially opens out in a curved manner and which changes over into a flange resting on the edge of the floor opening. Within the casing there is concentrically arranged an insert which tapers from top to bottom in a funnel-shaped manner and which possesses a mantle in the form of a truncated cone. The outside of this mantle and the inside of the casing define an annular space which at the level of the flange located at the collar of the casing is narrowed by a flange which has been placed at the insert and radially protrudes to the outside. By means of a vertically adjustable disk it is possible to close the outlet cross section of the insert until it becomes a ring slot.

With this known floor outlet it is possible to ensure a relatively large depth of horizontal penetration by the out flowing air supply and therefore to select a low density in the layout of the air outlets, while nevertheless uniformly supplying the entire room with additional air. In this case, the floor outlet has the effect of a floor well outlet through which the air supply is blown into the room essentially in a horizontal direction. However, it is not possible with the floor outlet to produce the effect of a floor twist outlet through which the air supply is blown into the room essentially in a vertical direction.

For the purpose of producing a twist air flow there is also already known from EP 0 446 557 A3 a floor outlet which has been provided, in a circular plate covering a casing, with outlet slots that point upward in a slanted manner. The plate consists of a pair of plates, with the outlet slots of each of the two plates being slanted in opposite directions. By a small rotation of the individual plates relative to each other it is possible to position the outlet slots shifted in an appropriate manner in relation to each other, making possible a limited change in the outflow direction of the air supply streams.

By means of this known floor outlet it is not possible, as in the case of a conventional twist outlet, to bundle the individual air streams which are blown into the room, into a uniform highly inductive total stream which steeply rises into the room.

SUMMARY OF THE INVENTION

The present invention addresses the task of constructing a floor outlet for air distribution in such a manner that it provides the choice of the horizontal blowing-out properties of outlets formed as floor well outlets and the vertical air stream of a floor twist outlet.

Briefly stated, the device includes a cylinder having a cover plate including an inner and an outer series of inclined slots. A disk is shiftable toward and away from the plate. In the upper position the plate blocks the inner series of slots. When the disk is in its upper position air flow is limited to the outer series of slots resulting in a generally vertical twist pattern of flow. In the lowered position air flows through all of the openings resulting in a generally horizontal flow pattern.

According to further embodiments of the invention, the outlet cross sections of the slots which cross the outer partial circle are narrowed in their width by strips which are formed as part of the plate, with a strip being allocated to each of these slots on the longitudinal soffit which is slantingly oriented in the direction of the inflow cross section of the slot.

When the floor outlet is operated as a floor well outlet the strips promote a redirection of the streams into the horizontal plane, with the out flowing air streams, as a result of the Koanda effect, clinging to the floor of the room which is to be ventilated. At the same time, the air streams which flow out through the slots allocated to the inner partial circle are redirected by the horizontally out flowing air streams in their direction. If the floor outlet is operated as a twist outlet, no air streams flow out of the slots allocated to the inner partial circle so that an under pressure is created within this central area, as a result of which the air streams in spite of the strips are redirected into a vertical direction and combine with each other. As a result of the thus produced total stream the additional air flows steeply upwards.

Finally, an embodiment of the invention also provides that each of the slots crossing the outer partial circle in the area of the inflow cross section defines, with a longitudinal soffit which is oriented in a slanting manner pointing away from the inflow cross section, a convex arc.

By means of this embodiment there not only is produced an enlargement, on the inflow side, of the opening cross section of the slots allocated to the larger partial circle as compared to the outflow cross section of these slots which is narrowed by the strip, but additionally a sharp-edged formation of the inflow cross section, which could cause noises in the case of high stream velocities, is avoided.

The drawing shows an example of an embodiment of a floor outlet in accordance with the invention; this example is described in greater detail later on.

BRIEF DESCRIPTION OF DRAWINGS

FIG. 1 shows a vertical cross section through the floor outlet.

FIG. 2 shows a view of the floor outlet from above.

DETAILED DESCRIPTION OF DRAWINGS

Figure 3:
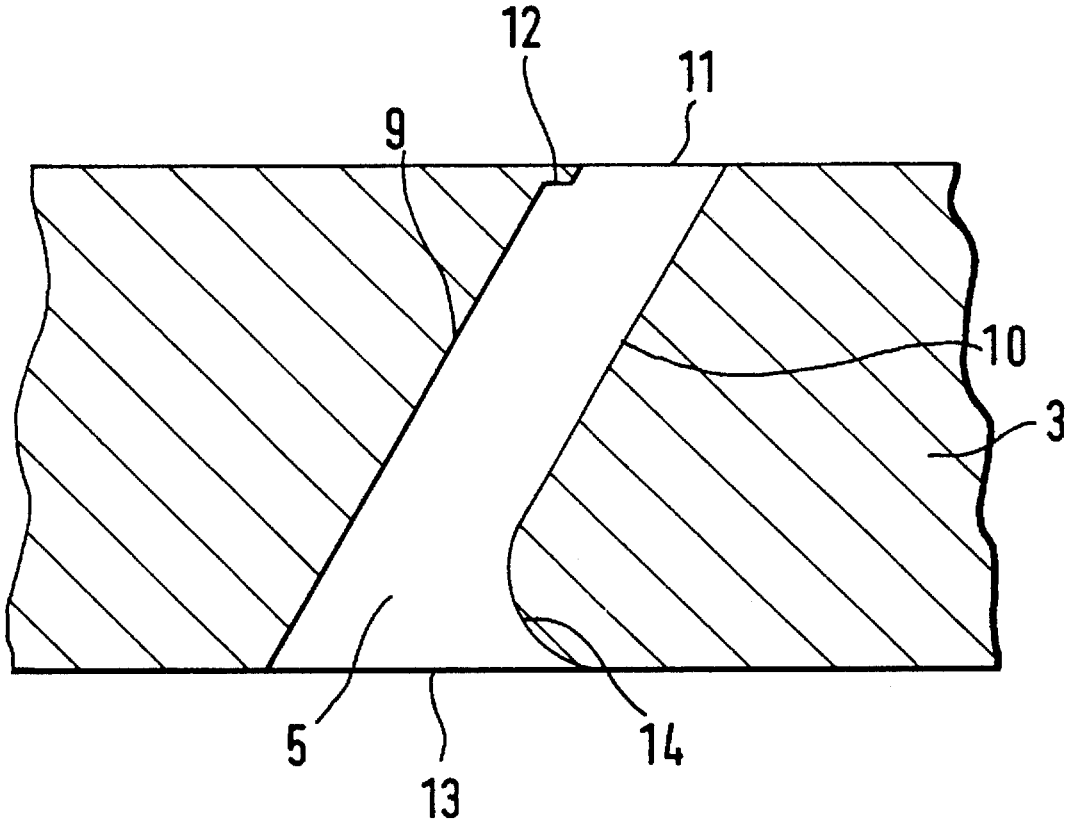
FIG. 3 shows a partial cross section, in the area of a slot, of a plate covering the floor outlet.

The floor outlet which can be placed into a floor opening which is not shown, and which with its upper side flushly adjoins the floor surface, comprises a cylindrical casing 1 which has been provided with a conventional (and therefore not shown in detail here) throttling device for the total volume of the stream to be supplied to the floor outlet. In the casing 1 there has been inserted an equally cylindrical dirt trapping basket 2 of the usual construction.

On its uppermost side the casing 1 is covered by a circular plate 3 which forms an outlet body. Under the plate 3 a vertically adjustable disk 4 is arranged in a known manner on a spindle 15 which is coaxial with the plate 3. The disk is shiftable, in known manner, such that in its upper position the disk 4 flushly rests against the lower side of the plate 3 or can be moved into the lower position which is shown.

As shown in FIG. 2, the plate 3 has been provided with radial slots 5 and 6, with the slots 5 allocated in a uniform distribution to an outer partial circle 7, and the slots 6 allocated, again in a uniform distribution, to an inner partial circle 8.

As FIG. 3 shows by way of the example of a slot 5, the slots 5 and 6 are defined by longitudinal soffits 9 and 10 running in a slanting manner. In contrast to the slots 6, in the case of each slot 5 an outflow cross section 11 is narrowed by a strip 12 which is formed as part of the plate 3 and which protrudes over the plane of the longitudinal soffit 9. An inflow cross section 13 is enlarged by the longitudinal soffit 10 which terminates downwards in a convex arc 14.

With the disk 4 in the lowered position shown in FIG. 1 a generally horizontal air distribution results. When the disk is raised to abut the under surface of plate 3, air flow is limited to outer slots 5 resulting in a generally vertical air stream.

As will be apparent numerous variations of construction may occur to those skilled in the art and familiarized with the instant disclosure. Accordingly, the invention is to be broadly construed within the scope of the appended claims.

Having thus described the invention and illustrated its use, what is claimed as new and is desired to be secured by Letters Patent is:

1. In a floor mountable air outlet comprising a cylindrical casing having an upwardly open mouth, a circular plate covering said mouth and a circular disk parallel to said plate having adjusting means for shifting said circular disk toward and away from said plate from an upper position adjacent said plate to a lower position spaced from said plate, said plate including outlet openings, the improvement wherein said outlet openings are comprised of a first series of uniformly spaced openings extending radially of said plate, said first series being arranged with their radial innermost ends terminating a first distance from the center of said circular plate, a second series of uniformly spaced openings extending radially of said plate, the openings of said second series having their radial outermost extremities located in the area of said plate between said center and said radial innermost ends of the openings of said first series, said openings of said first and second series being angularly inclined in a common direction relative to the plane of said plate, said disk in said upper position blocking said openings of said second series.

2. An outlet in accordance with claim 1, wherein the lowermost extremity of said other wall is defined by an arcuate surface.

3. In a floor mountable air outlet comprising a cylindrical casing having an upwardly open mouth, a circular plate covering said mouth and a circular disk parallel to said plate having adjusting means for shifting said circular disk toward and away from said plate from an upper position adjacent said plate to a lower position spaced from said plate, said plate including outlet openings, the improvement wherein said outlet openings are comprised of a first series of uniformly spaced openings extending radially of said plate, said first series being arranged with their radial innermost ends terminating a first distance from the center of said circular plate, a second series of uniformly spaced openings extending radially of said plate, the openings of said second series having their radial outermost extremities located in the area of said plate between said center and said radial innermost ends of the openings of said first series, said openings of said first and second series being angularly inclined in a common direction relative to the plane of said plate, said inclined openings being defined by a pair of generally parallel walls formed in said plate, first said wall of said pair being inclined at an acute angle with respect to the upper surface of said plate and the other said wall being inclined at an obtuse angle with respect to said upper surface.

4. An outlet in accordance with claim 3, wherein the lowermost extremity of said other wall is defined by an arcuate surface.

5. In a floor mountable air outlet comprising a cylindrical casing having an upwardly open mouth, a circular plate covering said mouth and a circular disk parallel to said plate having adjusting means for shifting said circular disk toward and away from said plate from an upper position adjacent said plate to a lower position spaced from said plate, said plate including outlet openings, the improvement wherein said outlet openings are comprised of a first series of uniformly spaced openings extending radially of said plate, said first series being arranged with their radial innermost ends terminating a first distance from the center of said circular plate, a second series of uniformly spaced openings extending radially of said plate, the openings of said second series having their radial outermost extremities located in the area of said plate between said center and said radial innermost ends of the openings of said first series, said openings of said first and second series being angularly inclined in a common direction relative to the plane of said plate, said inclined openings being defined by a pair of generally parallel walls formed in said plate, a first said wall of said pair being inclined at an acute angle with respect to the upper surface of said plate and the other said wall being inclined at an obtuse angle with respect to said upper surface, and strip means on said upper surface forming a continuation of said first wall and extending part way toward said other wall.

* * * * *